US006876716B2

(12) United States Patent
Sjogren et al.

(10) Patent No.: US 6,876,716 B2
(45) Date of Patent: Apr. 5, 2005

(54) METHOD AND APPARATUS FOR UTILIZING A SHADOW EFFECT FOR COUNTING NEWSPAPERS, MAGAZINES, BOOKS, PRINTED PRODUCTS, SIGNATURES AND OTHER LIKE PRINTED MATTER

(75) Inventors: Christer A. Sjogren, Miami, FL (US); Jeremy A. Hyne, Miami, FL (US)

(73) Assignee: Quipp Systems, Inc., Miami, FL (US)

( * ) Notice: Subject to any disclaimer, the term of this patent is extended or adjusted under 35 U.S.C. 154(b) by 0 days.

(21) Appl. No.: 10/369,026

(22) Filed: Feb. 19, 2003

(65) Prior Publication Data

US 2004/0161072 A1 Aug. 19, 2004

(51) Int. Cl.[7] ..... G06M 11/00
(52) U.S. Cl. ..... 377/8
(58) Field of Search ..... 377/8

(56) References Cited

U.S. PATENT DOCUMENTS 5,367,362 A * 11/1994 Forest ..... 399/43
5,614,709 A * 3/1997 Smith ..... 250/223 R
5,614,710 A * 3/1997 Mondie et al. ..... 250/223 R
6,370,216 B1 * 4/2002 Lawandy et al. ..... 377/8

* cited by examiner

*Primary Examiner*—Margaret R. Wambach
(74) *Attorney, Agent, or Firm*—Volpe and Koenig, P.C.

(57) ABSTRACT

Printed products, such as newspapers are fed past a counting station arranged in imbricated fashion, preferably folded edges passing downstream first. A high intensity light source is arranged so that its light beams are oriented at an angle which, while illuminating upper surfaces of the newspapers, causes the forward folded edges to cast a shadow upon the upper surface of a downstream newspaper that the forward edge of the newspaper creating the shadow rests upon. An image sensing device creates an image of a given region which includes the leading edge of the newspaper creating the shadow. This image is compared with stored criteria to determine if the "shadow" is due to a leading edge of a newspaper and to thereby discriminate a newspaper leading edge from other spurious conditions which, although they may create a "shadow", fail to meet the criteria of a leading edge of a newspaper.

49 Claims, 5 Drawing Sheets

METHOD AND APPARATUS FOR UTILIZING A SHADOW EFFECT FOR COUNTING NEWSPAPERS, MAGAZINES, BOOKS, PRINTED PRODUCTS, SIGNATURES AND OTHER LIKE PRINTED MATTER

FIELD OF INVENTION

The present invention relates to printed product counters. More particularly, the present invention relates to method and apparatus for counting printed products and the like through detection of a shadow which identifies a printed product when the "shadow" meets certain criteria. "Printed product" as used herein, includes newspapers, magazines, books, pamphlets, signatures and the like.

BACKGROUND

The publishing industry and, particularly the newspaper industry, has need to accurately count printed products for a variety of applications which include the formation of printed product bundles of a precise count, to name just one such application.

A number of different counting devices have been utilized in the publishing/newspaper field among which include mechanical counters, optical counters, and the like. It has also been well known in the industry for many years that existing technology employed to count printed products being conveyed on a conveyor without a gap between each product has been found to be far from perfect. One of the most common approaches at present is the utilization of a laser beam to detect the folded edge, i.e. the "spine", of each printed product as it passes the laser beam.

Although the laser beam has replaced mechanical and other optical devices, since the laser beam has a diameter of the order of one millimeter, objects other than the folded edge, such as wrinkles, pin holes, tears, debris and loose paper material can easily trigger a false count. It is thus extremely valuable to provide a method and apparatus which substantially eliminates false counts.

SUMMARY

The present invention provides a technique utilizing a count sensor which images an area significantly greater than an area of one millimeter diameter and the sensed image, together with stored criteria, provides intelligence sufficient to analyze the image created in the detected area in order to be able to discriminate between a leading edge and conditions which otherwise cause the development of a false count.

BRIEF DESCRIPTION OF THE DRAWING(S)

The present invention will be understood from a consideration of the accompanying specification and drawings in which like elements are designated by like numerals and, wherein:

FIG. 1 shows a simplified diagrammatic view of apparatus employed to accurately count signatures and the like and embodying the principles of the present invention.

FIG. 1*a* is a perspective view of a portion of the apparatus shown in FIG. 1.

DETAILED DESCRIPTION OF THE PREFERRED EMBODIMENT(S)

Figure 1:
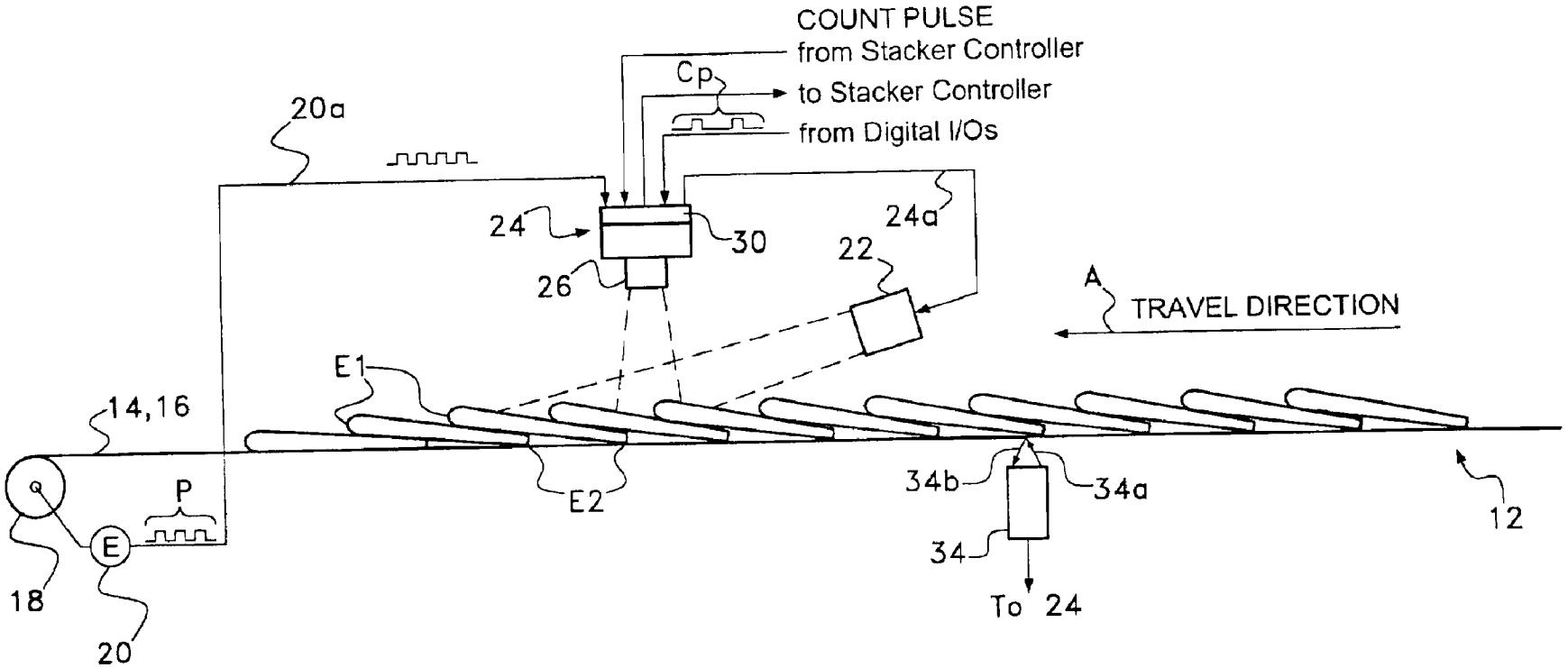
Figure 1A:
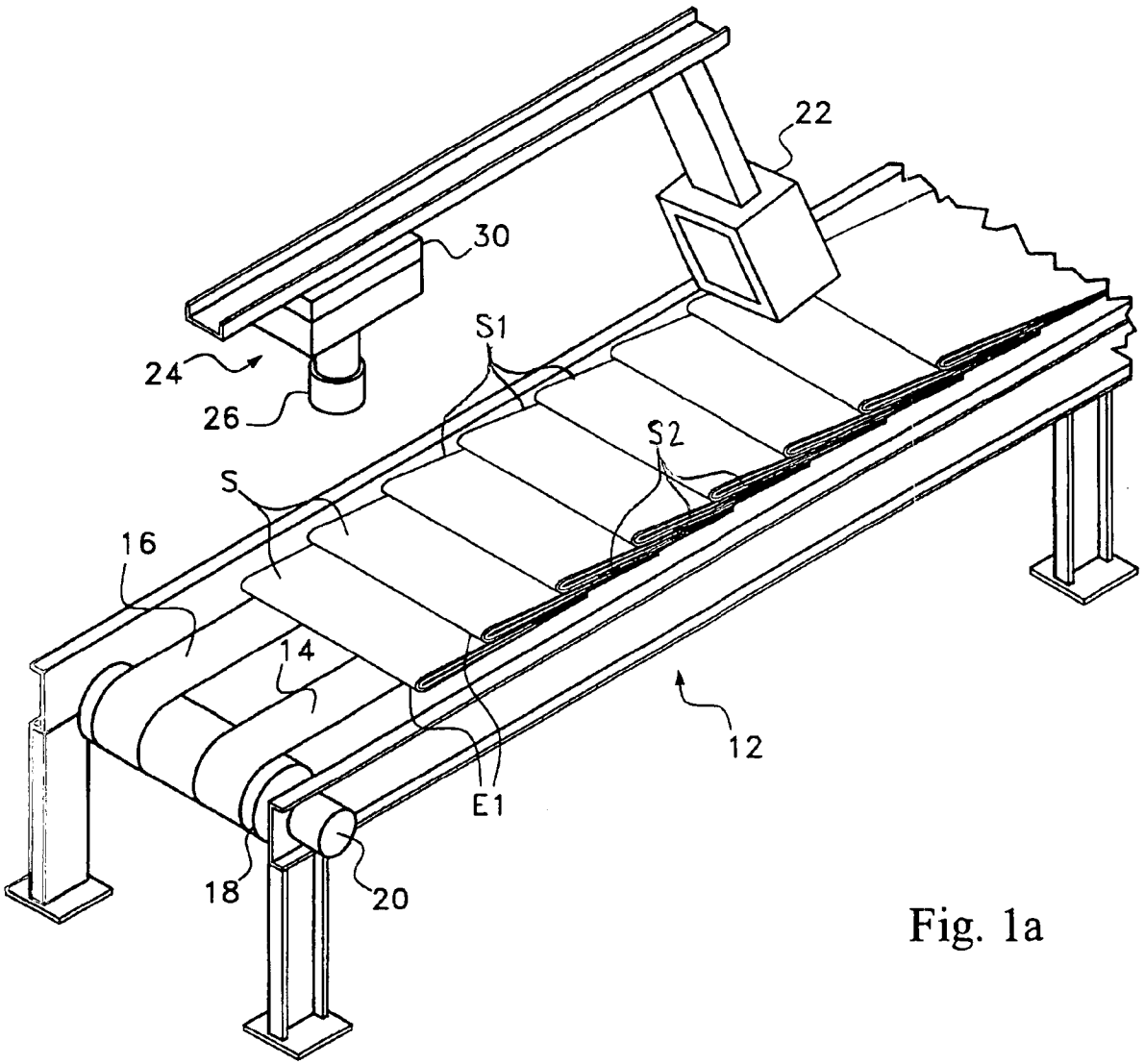
Figure 2:
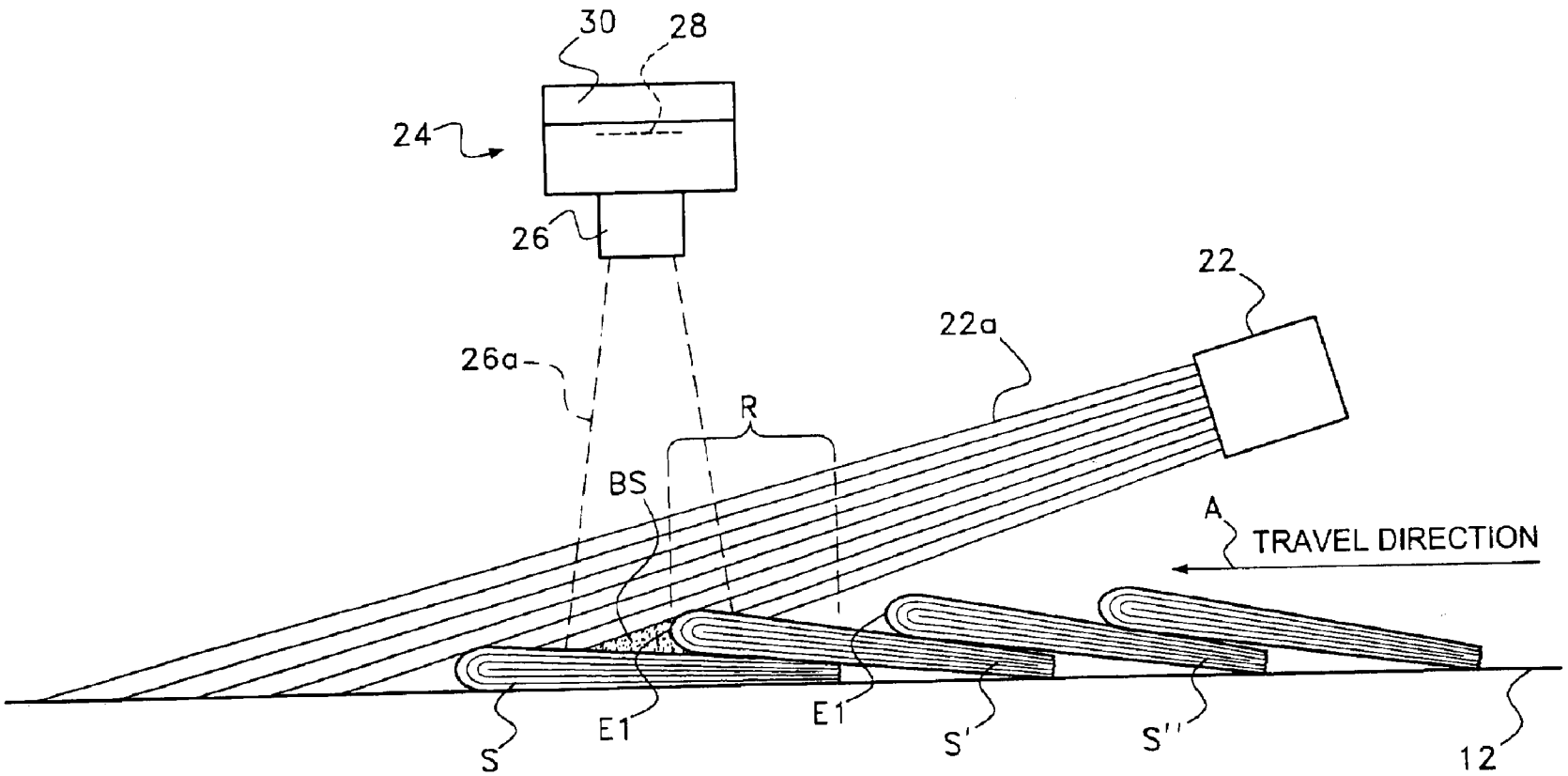
FIG. 2 shows a more detailed view of a portion of the apparatus shown in FIG. 1 and which is useful in explaining the novel technique of the present invention.

Making reference to FIGS. 1 and 2, the apparatus 10 utilized to practice the novel technique of the present invention comprises a conveyor 12 which, as shown in FIG. 1*a*, is in turn comprised of first and second conveyor belts 14, 16 movable along fixed support surfaces 15, 17. The conveyor belts 14, 16 are driven by a suitable drive motor, not shown for purposes of simplicity, and move in the direction of arrow A. A rotating roller 18 converts the linear movement of the conveyor belts 14, 16 to a rotational movement. Shaft encoder 20, coupled to roller 14, generates pulses whereby a pulse is generated for a predetermined travel distance in the direction of travel. In one preferred embodiment, each pulse is generated to represent travel of the conveyor belt of a distance of the order of 0.25 inches. However, pulses representative of a greater or lesser travel distance may be utilized.

As another alternative the conveyor may be operated at a constant speed and pulses from a pulse generator operating at a frequency which is related to the linear speed of the belts 14, 16 may be employed. Thus, the pulse generator 20 may be electronically and mechanically isolated from the conveyor. The term pulse generator as used herein refers to either a pulse generator isolated from the conveyor or an encoder generating pulses responsive to the linear speed at which printed products are conveyed.

Conveyor belts 14, 16 support and convey printed products S in the direction of travel A. The printed products are arranged in imbricated fashion, being fed onto the conveyor with their folded edges or "spine" E1 downstream relative to their cut edges E2, the printed products being arranged in imbricated fashion so that the spine E1 of each upstream printed product overlays the next adjacent downstream printed product.

A high intensity light source 22 such as, for example, a high intensity strobe light, is aligned at an angle as shown in FIGS. 1 and 2 so that the light beams emitted there from form an angle of less than 90° and typically of the order of 30° to 60°, with the surface of conveyor 12. The strobe light, in one preferred embodiment, is capable of flashing 250 times per second.

A high speed digital sensor 24 which may, for example, be a digital camera, is positioned a spaced distance above the conveyor 12 and is comprised of a lens barrel 26 which incorporates lenses (not shown for purposes of simplicity) for focusing an image onto an image sensing device which may, for example, be a charge couple device (CCD) comprised of a number of pixels, each pixel being sensitive to light, so as to develop a signal of a value representative of the light level of the portion of the image impinging upon the pixel. The pixels are preferably arranged in a regular grid of rows in columns sufficient in number to provide adequate resolution to recognize a leading edge of a signature with a desired level of accuracy.

The high speed electronic camera 24 may be provided within its housing with the electronics 30 necessary for storing the software utilized to compare detected images with stored criteria data to determine if the image meets the criteria necessary to accurately identify and count a signature.

The high speed camera is located at a position to capture an image of a region intermediate the two sides of the stream of printed products and above the gap between the conveyor belts 14, 16. This region, will hereafter be referred to as the intermediate region, wherein that term intermediate region shall mean herein the region intermediate the sides S1, S2 of the printed products (see FIG. 1*a*).

In one preferred embodiment, the optical axis of the lens barrel 26 is preferably arranged substantially at a right angle to the direction of travel A and is positioned approximately 6 to 8 inches above the printed products being counted. However, the orientation and distance values may be changed without altering the effectiveness of the invention.

The strobe light 22 is also preferably mounted at a location upstream relative to the electronic camera and spaced therefrom by a distance on the order of 6 to 10 inches. The strobe light beam is oriented so as to form an angle with the travel direction which is on the order of 30° to 60°. These values may also be adjusted without departing from the effectiveness of the invention.

Encoder 20 is geared so that an output pulse is generated approximately every 0.25 inches of belt travel. These pulses are applied to the electronic high speed camera 24 through lead 20*a*, these pulses being conveyed by camera 24 to the strobe light 22 through lead 24*a*. Alternatively, the strobe pulses may be directly applied to the strobe light 22 by encoder 20. The conveyor belts 14, 16 are spaced apart by a distance typically on the order of several (3 or 4) inches. Although the figures show printed products, such as newspapers, being conveyed, the invention works equally well with other printed products such as inserts, magazines, books, pamphlets and the like. More than two (2) belts may be employed for conveying the printed products, the strobe light 22 and sensor 24 being positioned above a gap between two (2) of the conveyor belts.

Each pulse P generated by the encoder 20 clears the image previously created by the camera 24 and causes a new image to be generated.

Making reference to FIG. 2, the angle formed between the light beams 22*a* from the strobe 22 and the printed products S cause a black (or dark) shadow BS be formed in the region which includes a forward folded edge E1 of a printed product, which shadow is cast upon the upper surface of the downstream signature upon which the forward edge being illuminated is resting. The dashed lines represent the region being imaged by the lens barrel 26 upon the sensor device 28. The light beams 22*a* form an elongated "bar" across substantially the entire width of the printed products S and S' in FIG. 2.

Figure 3:
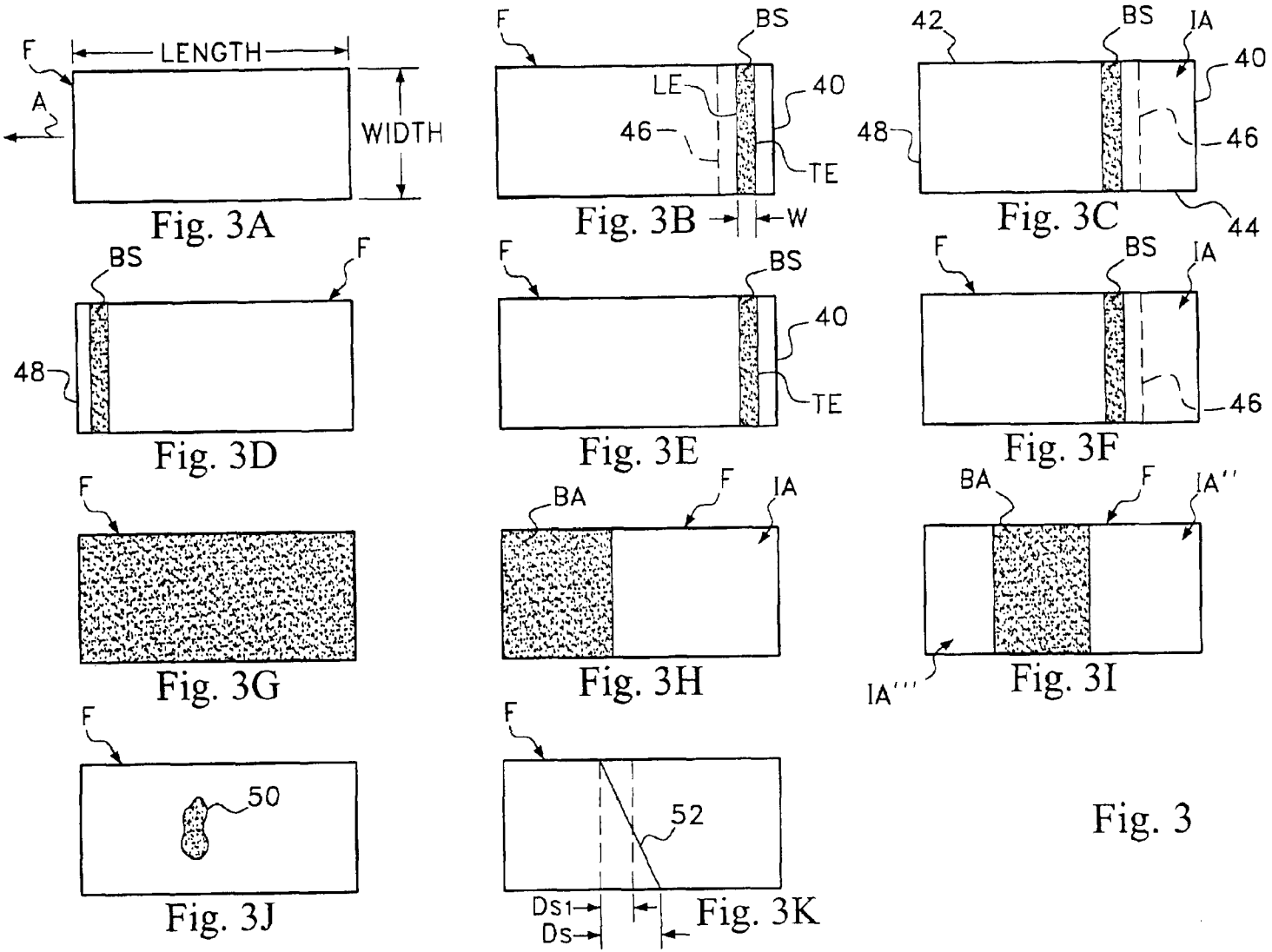
FIGS. 3A–3K show different views of the image created by the sensor which are then compared with stored criteria in order to accurately and positively identify each signature and discriminate a signature from all other conditions which might otherwise mistakenly create a false count.

The criteria utilized in the present invention is to trigger a count of a signature when the image goes from black to white, i.e. at the trailing edge of the black shadow BS which is adjacent the leading edge E1 of the signature S' shown in FIG. 2 and when the aforesaid transition from black to white lies within an image area IA as shown, for example, in FIGS. 3B and 3C.

The operation of the present invention will be understood from a consideration of FIGS. 3A–3K, as set forth below.

Each image projected onto the sensor 28 by the lens barrel optics 26, in one preferred embodiment, has a length in the travel direction on the order of two (2.0) inches and a width in the direction perpendicular to the distance of travel on the order of one (1.0) inch. Each image generated by the digital camera is, analyzed by a software driven process in which "black bars" meeting the criteria of a particular orientation, width and length are identified as the presence of a signature. "Black bar" or "bar" used herein means the shadow created by a folded edge which is cast upon a printed product that the folded edge forming the shadow is resting upon.

As one example, a one (1.0) inch by two (2.0) inch substantially angular-shaped image of strobe light reflected from the printed products is created responsive to each pulse P from the encoder 20. However, the image size may depart from a 1.0"×2.0" size without reducing the effectiveness, and efficiency of the present invention. A pulse P from encoder 20 clears the previous image created by camera 24, which then triggers the strobe light 22. As printed products are conveyed in the direction of travel A, a black bar appears for the first time at the right-hand end of the image formed within the frame F which defines the limit of the image field. Upon the occurrence of the next pulse, the previous image is cleared and a new image is created whereby the black bar moves approximately 0.25 inches downstream relative to the last image. The software prevents counting of the black bar at the second image position since the new position is to the left of the previous image and thus falls outside of the criteria wherein the black bar was first recognized and the downstream black bar BS is thus identified as a printed product which has already been counted. The camera 24 is preferably positioned above the gap between conveyor belts 14, 16 so that no strobe light is reflected from a belt when no printed product is present in this region.

Any new black bar entering at the right-hand end of the image area IA will be counted.

FIG. 3A represents a time instant at which a region R between the forward folded edges E1 of printed products S' and S" are positioned outside of the field of view of the camera 24, i.e., are outside of the range of the lens barrel optics 26 presented by dashed lines 26*a*.

FIG. 3B shows an image captured by the sensor 28 in which the black bar representing the black shadow region BS is just a short distance downstream relative to the right-hand (upstream) end 40 of the frame F representing the image area projected onto the sensor 28. The bar BS lies within the image area IA.

FIG. 3C shows a bar representing the shadow BS 0.25 inches further downstream relative to the image shown in 3B. This image is identified as the previous image since it is outside of the image area IA defined by upper and lower sides 42 and 44 of frame F, and the right-hand side 40 of frame F and dotted line 46 and thus will not be counted as a new printed product. In this regard, it should be noted that when a bar B5 lies in the image area IA, the pulses triggering operation of the sensor 24 are spaced by a distance sufficient to assure that the next image falls outside of the image area IA to prevent a bar BS from being erroneously detected a second time.

FIG. 3D shows the bar of FIG. 3C which is moved to a downstream location immediately adjacent the left-hand end 48 of the frame F which defines the total image area. Since this bar BS lies outside of the area IA, it will not be counted as a new printed product.

FIG. 3E shows an image containing a black bar which identifies a new printed product appearing slightly downstream of the right-hand edge 40 of the image field F. Since this is a bar just entering into the field of view F, a count pulse will be generated when a transition between a black image and a white image occurs, i.e. at the trailing edge TE of the bar BS, shown in FIG. 3E.

FIG. 3F shows an image of the bar BS which represents the movement of the bar BS of FIG. 3E in a downstream direction on the order of 0.25 inches. Since this bar is outside of the image area IA, i.e., is downstream relative to image area IA, no count is generated.

FIG. 3G shows an image generated when there are no bars, i.e., no printed products inside of the image frame F. This represents the total absence of printed products S due to the fact that no or substantially very little light is reflected into the camera. It should be noted that the field of view F is preferably positioned in the gap region between conveyor belts 14, 16 where there are no reflective surfaces to reflect the strobe light and thus create a false signal.

FIG. 3H depicts a situation in which a printed product has entered the image field F. The large black area BA indicates that there is no product in front of the printed product which occupies that region IA'. This condition also represents the case wherein the white portion of the image entered the image field F several pulses earlier. Since a count pulse is generated only when the image goes from black to white, the count pulse in the example given in FIG. 3H was generated as soon as the white field entered the right side of the image Field.

FIG. 3I represents a condition in which the wide black bar BA indicates a large gap between an upstream product occupying the region IA'" and the trailing edge of downstream product occupying the region IA".

FIG. 3J shows an image created by the camera 24 having a spot 50 which occupies a small region within the image field F and this "spot" clearly should not meet the criteria for a black shadow created across the width of a printed product by the strobe light 22. The criteria requires that a black bar of a certain width, length and orientation be present in the image field to be identified and counted as a valid signature.

FIG. 3K shows an image in which a diagonally aligned black streak 52 is present. This black streak 52, although it spans across the entire width of the frame F representing the image field, is most likely to be a wrinkle or a loose paper or some other imperfection and since it fails to meet the width, length and orientation standards, it will not be counted.

Figure 4:
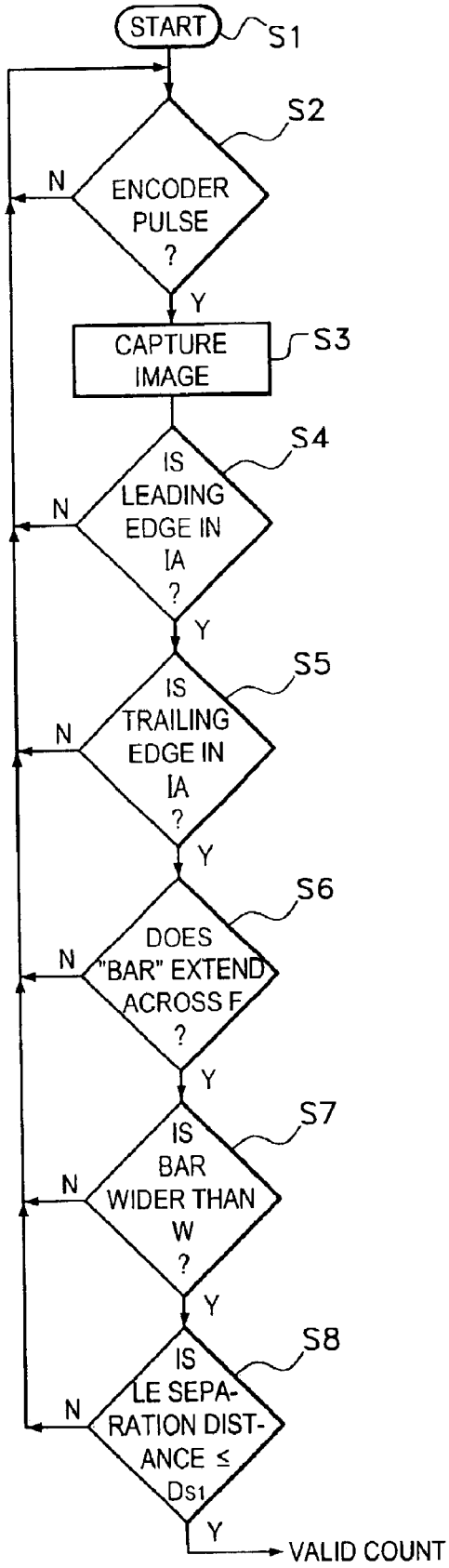
FIG. 4 is a flow diagram of the method performed by the apparatus of FIG. 1.

One program which may be utilized for comparing the image created by the camera is shown in the flow diagram presented in FIG. 4. Upon the start of the routine, at step S1, the apparatus, including the camera, is initialized. Encoder pulses are looked for, at step S2. When an encoder pulse is present, the routine branches to step S3. If no encoder pulse is present, the program continues to loop back to step S2.

At step S3, a determination is made as to whether leading edge LE of a bar BS lies within the region IA. If not, the program loops back to step S2. If the leading edge lies within the region IA, the routine branches to step S5 to determine if the trailing edge lies within the region IA. If it does not, the routine returns to step S2.

If the trailing edge TE lies within the region IA, the routine branches to step S6 to determine if the bar extends along the width of the image area. If not, the routine returns to step S2. If the bar does extend across the image field F, the routine branches to step S7 to compare the width of the bar BS in the travel direction A. If the bar is equal to or greater than a predetermined width W (see FIG. 3B), the routine branches to step S8. If it does not, the routine returns to step S2. It should be noted that the width of the bar is a function of the thickness of the printed product is the region of the spine of the printed product. This value can be set for a given or minimum printed product thickness and is a function of the angle formed between the strobe light beams 22A and the conveyor 12 as well as the thickness of the printed product leading edge.

When the width of the bar is equal to a greater than a preset threshold level, the routine advances to step S8, which determines the angle which the leading edge makes with the direction of travel, by measuring the distance between the opposite ends of the leading edge LE of the bar. Making reference to FIG. 3K, it should be noted that the opposing ends of the image 52 are separated by a distance $D_s$. A separation distance threshold value is set. For example, the threshold distance value may be set at $D_{s1}$. When the separation distance is equal to or less than the threshold value, this constitutes acceptance of the bar as indicative of the presence of a valid signature. The count pulses CP are delivered from the electronics 30 to a stacker which uses the count pulse to form stacks of a given count.

The strobe light 22 and digital camera 24 employed herein are capable of respectively flashing and taking a new image 250 times per second. However, a greater or lesser repetition rate may be chosen. For example, assuming printed products such as newspapers are being delivered to the conveyor 12 at the rate of 72,000 per hour, i.e., 20 papers per second and with approximately a three (3.0) inch lap between leading edges (i.e., spines) with a minimum of 2.50 inches, to assure proper intercept by a stacker blade, since the stacker normally requires 50 milliseconds for an intercept operation. Thus, to track the newspapers, a new image is preferably taken every 0.250 inches of travel. For example, a camera taking an image every 1/20 of a second is unacceptable since a newspaper will travel 3.00 inches in 1/20 of a second which would move a shadow out of the image field F. However, with a digital camera taking a new image every 1/250 of a second the newspaper will travel approximately 0.250 inches which is satisfactory for accurately counting newspapers and providing count pulses at a rate sufficient to assure proper intercept operation of a stacker receiving count pulses CP.

Although a strobe light is preferable to a light source which is continuously illuminated, a continuously lit light source may be employed. The strobe light source is preferable since it conserves energy and lengthens the operating life of the light source.

To further conserve energy a sensor such as a photosensor 34 comprised of a light source/receiver is provided to detect the presence of a printed product stream to prevent operation of the digital camera 24/strobe light 22 in the absence of a stream of products. When the light beam 34*a* is reflected 34*b* from the bottom of the stream and is detected by the receiver, the sensor 34 enables operation of the strobe light 22/digital camera 24. The digital camera electronics 30 may be coupled to the stacker controller to receive parameters such as printed product thickness to change parameters in the criteria employed to evaluate the images created by the digital camera. The stacker controller and/or the electronics 30 may select one or more of a plurality of routines stored in the electronics 30 for evaluating images. Alternatively, the electronics 30 may be coupled to digital I/O's employed to change parameters and/or select a given stored program.

What is claimed is:

1. A method for identifying and counting printed products conveyed along a conveying path in a stream past a monitoring station in imbricated fashion with folded edges of each upstream printed product facing in a downstream direction and lying upon an upper surface of an adjacent downstream printed product, comprising:

(a) triggering illumination of a light source at a rate relate to a linear speed of the printed products whereby folded edges of printed products conveyed through a region of an illuminating light beam from the light source which light beam forms an angle with the light path, to cause a shadow to form only on an upper surface of a downstream signature upon which the folded edge of the upstream printed product is placed;

(b) substantially simultaneously with each triggering of the light source, capturing an image of a given region containing the shadow formed on each printed product passing through the monitoring station and intermediate opposite sides of said printed product; and (c) comparing the captured image with predetermined criteria to determine a presence of a leading edge to prevent disturbances from being erroneously identified as a leading edge.

2. The method of claim 1 wherein step (b) comprises capturing an image upon a sensor.

3. The method of claim 2 wherein step (b) comprises capturing an image upon a sensor having an array of light sensitive pixels.

4. The method of claim 2 wherein step (b) comprises capturing an image upon a sensor having pixels provided as part of a charged-coupled-device (CCD).

5. The method of claim 1 wherein step (c) comprises comparing the captured image with criteria including length, width, and orientation to establish presence of a leading edge.

6. The method of claim 1 further comprising:

generating pulses at a rate related to a linear speed of the moving printed products.

7. The method of claim 6 wherein the printed products are moved at a constant rate.

8. The method of claim 7 including employing the pulses generated to capture an image.

9. The method of claim 6 wherein the printed products are moved at a variable rate.

10. The method of claim 9 including employing the pulses generated to capture an image.

11. The method of claim 6 including the pulses generated to capture an image.

12. The method of claim 6 wherein said pulses are generated at a rate to prevent two successive images of a given printed product from occurring in said given region.

13. The method of claim 1 wherein step (c) includes identifying a presence of a printed product folded leading edge when an image of the shadow has a length measured in the conveying direction which is at least as at as a given threshold value.

14. The method of claim 1 wherein step (c) includes identifying a presence of a printed product folded leading edge when leading edge of an image of the shadow is oriented within a given angular range relative to said downstream direction.

15. The method of claim 1 wherein step (c) includes identifying a presence of printed product folded leading edge when a image of the shadow lies within a given region of an image field.

16. The method of claim 1 further comprising:

generating a count when a trailing edge of a captured image of a shadow transitions from dark to light.

17. The method of claim 1 wherein step (b) includes forming an angle of less than 60° between the light beam and conveying path along which the printed products are conveyed.

18. The method of claim 1 further comprising:

preventing steps (a) and (b) from being performed until the stream of printed products passes a given location alone the conveying path.

19. The method of claim 1 wherein step (a) further comprises:

triggering said light source every time the stream of printed products is advanced by a distance of the order of 0.25 inches.

20. The method of claim 1 wherein step (b) further comprises:

capturing a substantially rectangular shaped image; and wherein step (c) further comprises:

comparing said captured image with a store substantially rectangular-shaped image serving as the predetermined criteria.

21. The method of claim 1 wherein step (a) further comprises providing a light beam sufficient to form said shadow and which occupies at least said given region; and the comparing step (c) further comprises:

providing a stored image having a size which conforms to said given region as said predetermined criteria.

22. A method for identifying and counting printed products conveyed in a stream past a monitoring station in imbricated fashion with folded edges facing in a downstream direction, comprising:

(a) generating pulses related to a linear speed of the printed products being conveyed;

(b) illuminating the printed products with light directed at an angle so as to cause a leading folded edge of a printed product to form a shadow on a surface of a printed product upon which the leading folded edge is placed;

(c) during illumination of the light source, capturing an image of an intermediate region of the printed products passing through the monitoring station responsive to each pulse generated during step (a); and (d) comparing the captured image with predetermined criteria to determine a presence of a leading edge to prevent disturbances from being erroneously identified as a leading edge.

23. Apparatus for identifying and counting printed products conveyed in a stream past a monitoring station in imbricated fashion with folded edges facing in a downstream direction, comprising:

a pulse generator for generating pulses at a rate related to a rate of movement of the printed products being conveyed;

a light source being triggered responsive to pulses from the pulse generator whereby folded edges of printed products conveyed through a region of a light beam from the light source cause a shadow to form on a surface of a downstream printed product upon which the folded edge of the upstream printed product is placed;

a normally inactive sensor activated substantially activated simultaneously with triggering of the light source, capturing an image of a given region containing the shadow created on the printed products passing through the monitoring station responsive to each pulse generated by said pulse generator; and means for comparing the captured image with predetermined criteria to determine a presence of a leading edge and thereby prevent disturbances from being erroneously identified as a leading edge.

24. The apparatus of claim 23 wherein said sensor comprises a charged-coupled-device (CCD).

25. The apparatus of claim 23 wherein said means for comparing compares a captured image with criteria stored in a memory including length, width, and orientation to establish presence of a leading edge.

26. The apparatus of claim 20 further comprising:

means for generating a count when a trailing edge of a captured image of a shadow transitions from dark to light.

27. The apparatus of claim 20 wherein said means for comparing includes means for identifying a presence of a printed product folded leading edge when an image of the shadow has a length measured in the conveying direction which is at least as great as a given threshold value.

28. The apparatus of claim 20 wherein said means for comparing includes means for identifying a presence of printed product folded leading edge when a leading edge of the image of the shadow is oriented within a given angular range relative to said downstream direction.

29. The apparatus of claim 23 wherein said means for comparing includes means for identifying a presence of printed product folded leading edge when an image of the shadow lies within a given region of an image field in which the image lies.

30. The apparatus of claim 29 wherein said pulse generator generates pulses at a rate to prevent two successive image of the shadow from occurring in said given region.

31. The apparatus of claim 23 wherein said light source is arranged to form an angle of less than 90° between the light beam and a conveying surface along which the printed products are conveyed.

32. The apparatus of claim 23 wherein said printed products are conveyed at a substantially constant linear speed.

33. The apparatus of claim 23 wherein the pulse generator generates pulses at a rate which changes responsive to changes in the linear speed at which the printed products are conveyed.

34. The apparatus of claim 23 wherein said sensor comprises an array of light sensitive pixels.

35. The apparatus of claim 23 further comprising:

means for preventing operation of said sensor and said light source until the stream of printed products passes a given location.

36. Apparatus for identifying and counting printed products conveyed along a given path in a stream past a monitoring station in imbricated fashion with folded edges facing in a downstream direction, comprising:

a light source being triggered at a rate which is related to a linear speed of the printed products being conveyed whereby folded edges of printed products conveyed through a region of an illuminating light berm from the light source which is aligned at an angle of less than 90° to said given path to cause a shadow to form on a surface of only a downstream printed product upon which the folded edge of the upstream printed product is placed;

a normally inactive sensor activated substantially simultaneously with triggering of the light source, capturing an image of a given region of the printed products passing through the monitoring station; and means for comparing the captured image with predetermined criteria to determine a presence of a leading edge and thereby prevent disturbances from being erroneously identified as a leading edge.

37. The apparatus of claim 36 wherein the light source is triggered by a pulse generator.

38. The apparatus of claim 37 wherein the pulse generator generates pulses at a rate related to linear speed of the products being conveyed.

39. The apparatus of claim 36 wherein the light source and the sensor are triggered by a pulse generator.

40. The apparatus of claim 36 wherein the sensor is triggered by a pulse generator and the sensor triggers the operation of the light source.

41. The apparatus of claim 36 further comprising:

means for triggering said light source every time the stream of printed products is advanced by a distance of the order of 0.25 inches.

42. The apparatus of claim 36 wherein said sensor further comprises:

means for capturing a substantially rectangular-shaped image; and said means for comparing includes means for comparing said captured image with a stored, substantially rectangular-shaped image serving as the predetermined criteria.

43. The apparatus of claim 36 wherein said light source further comprises:

means for providing a light beam of a size sufficient to form said shadow and which occupies at least a portion of said given region; and said means for comparing comprises:

means for providing a stored image having a size which conforms to said given region which serves as said predetermined criteria.

44. The apparatus of claim 36 wherein said light source is aligned to create a shadow which has a rectangular shape.

45. The apparatus of claim 36 wherein said light source is aligned to create a shadow which has a given length measured in the conveying direction.

46. The apparatus of claim 36 wherein only one sensor is provided and said sensor is located downstream relative to said light source.

47. Apparatus for identifying and counting printed products conveyed in a stream past a monitoring station in imbricated fashion with folded edges facing in a downstream direction, comprising:

a pulse generator for generating pulses at a rate related to a linear speed of movement of the printed products being conveyed;

a light source for illuminating the printed products with light directed at an angle so as to cause a leading folded edge of a printed product to form a shadow on a surface of a printed product upon which the leading folded edge is placed;

a sensor, substantially simultaneously with illumination of the light source, capturing an image of an intermediate region of the printed products passing through the monitoring station responsive to each pulse generated; and means for comparing the captured image with predetermined criteria to determine a presence of a leading edge and thereby prevent disturbances from being erroneously identified as a leading edge.

48. The apparatus of claim 47 wherein said printed products are conveyed at a substantially constant linear speed.

49. The apparatus of claim 47 wherein the pulse generator generates pulses at a rate which changes responsive to changes in a linear speed at which the printed products are conveyed.

* * * * *

UNITED STATES PATENT AND TRADEMARK OFFICE

CERTIFICATE OF CORRECTION

PATENT NO. : 6,876,716 B2
DATED : April 5, 2005
INVENTOR(S) : Sjogren et al.

It is certified that error appears in the above-identified patent and that said Letters Patent is hereby corrected as shown below:

Column 6,
Line 66, after “rate”, delete “relate” and insert -- related --.

Column 7,
Line 38, after “including”, insert -- employing --.
Line 46, after second instance of “at”, insert -- great --.
Line 50, after “when”, insert -- a --.

Column 8,
Line 11, after “a”, delete “store” and insert -- stored --.
Lines 54-55, after “substantially”, delete “activated”.

Column 9,
Lines 3, 7 and 12, after “claim”, delete “20” and insert -- 23 --.
Line 23, after “successive” delete “image” and insert -- images --.
Line 49, after “light”, delete “berm” and insert -- beam --.

Signed and Sealed this

Tenth Day of January, 2006

JON W. DUDAS
*Director of the United States Patent and Trademark Office*